US005900846A

United States Patent [19]

Phelps et al.

[11] Patent Number: 5,900,846

[45] **Date of Patent: * May 4, 1999**

[54] FLEXIBLE TELESCOPING ANTENNA AND METHOD OF CONSTRUCTING THE SAME

[75] Inventors: Craig Phelps, Raleigh; Gerard Hayes, Wake Forest, both of N.C.

[73] Assignee: Ericsson, Inc., Research Triangle Park, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/701,126

[22] Filed: Aug. 21, 1996

[51] Int. Cl.[6] ..... H01Q 1/10

[52] U.S. Cl. ..... 343/901; 343/702; 343/903

[58] Field of Search ..... 343/702, 715, 343/900, 901, 903, 895

[56] References Cited

U.S. PATENT DOCUMENTS

| | | | |
|---|---|---|---|
| 2,491,601 | 12/1949 | Bernstein et al. | 343/901 |
| 4,325,069 | 4/1982 | Hills | 343/903 |
| 4,393,383 | 7/1983 | Yamashita | 343/903 |
| 4,658,260 | 4/1987 | Myer | 343/903 |
| 5,245,350 | 9/1993 | Sroka | 343/901 |
| 5,258,772 | 11/1993 | Inanaga et al. | 343/702 |
| 5,302,963 | 4/1994 | Wiggenhorn | 343/901 |
| 5,353,036 | 10/1994 | Baldry | 343/702 |
| 5,414,436 | 5/1995 | Shinkawa et al. | 343/903 |
| 5,446,469 | 8/1995 | Makino | 343/901 |
| 5,448,251 | 9/1995 | Gerszberg et al. | 343/903 |
| 5,479,178 | 12/1995 | Ha | 343/702 |
| 5,594,459 | 1/1997 | Hirota | 343/901 |

FOREIGN PATENT DOCUMENTS

| | | |
|---|---|---|
| 0 609 103 | 8/1994 | European Pat. Off. . |
| 1 514 962 | 6/1978 | United Kingdom . |
| 2 280 788 | 2/1995 | United Kingdom . |
| WO 93 26013 | 12/1993 | WIPO . |

*Primary Examiner*—Don Wong
*Assistant Examiner*—Tan Ho
*Attorney, Agent, or Firm*—Nixon & Vanderhye PC

[57] ABSTRACT

A flexible telescoping antenna is constructed of plastic tubular sections telescoping between an end section and a compact antenna. Conducting inserts are provided within the tubular sections and enable electrical contact at any extraction interval of the antenna. The antenna utilizing plastic telescoping sections allows maximum mechanical deflection and thereby resists breakage while providing optimum electrical performance.

26 Claims, 1 Drawing Sheet

FLEXIBLE TELESCOPING ANTENNA AND METHOD OF CONSTRUCTING THE SAME

BACKGROUND OF THE INVENTION

The present invention relates to mobile phones and like communication devices and, in particular, to a flexible telescoping antenna for such devices and a method of manufacturing the same.

With mobile communication devices and the like, a large antenna improves radiation performance. Many hand-held transceivers incorporate retracting antennas wherein increased performance can be obtained by extending the antenna to its maximum elongation. In this regard, when the increased performance is not required, the antenna may be retracted into a stowed position that occupies less volume.

Typically, retractable antennas consist of two primary types: a telescoping series of metallic, concentric cylinders that are reducible into the largest cylinder, and a simple rod that retracts into the housing of the transceiver. With respect to a simple rod retractable antenna, size constraints of the telecommunications equipment mechanical housing often prohibit the use of a simple retractable antenna. Conventionally, telescoping antennas are rigid metallic cylinders that are prone to permanent bending. Once bent, the cylinders lose their concentricity, and the process of retracting the antenna becomes increasingly difficult and often results in breakage. Furthermore, since telescoping antenna designs retract into a base metallic cylinder, electrical performance is severely degraded in the stowed position. If the extended length of the antenna is a minimum resonant length, the shorter stowed position will be non-resonant and therefore less efficient for radiation.

SUMMARY OF THE INVENTION

It is therefore an object of the invention to provide an antenna that overcomes the drawbacks associated with conventional antennas. In this regard, it is another object of the invention to provide a flexible telescoping antenna that provides optimum electrical performance and maximum mechanical deflection of telescoping sections without permanent deformation of the antenna. It is another object of the invention to enhance antenna performance at any antenna extraction interval including the stowed position.

These and other objects of the invention are achieved by providing a flexible telescoping antenna including an end section formed of a conducting material, a tubular section formed of a non-conducting material that slidably receives the end section, and a conducting insert disposed in the tubular section in electrical contact with the end section. The end section is preferably slidable through an opening in the tubular section. In this regard, the antenna further includes an end cap secured to an end of the end section that is formed of a conducting material and has a width that is greater than a diameter of the opening. The conducting insert is in electrical contact with the end cap. In a preferred arrangement, the conducting insert is disposed in the tubular section radially offset from a central axis of the tubular section or against a wall of the tubular section. The electrical contact may be galvanic contact or may be achieved with a capacitive coupling.

At least one subsequent tubular section formed of a non-conducting material may be provided slidably receiving the tubular section or other subsequent tubular sections. In addition, a compact antenna, which may comprise a plastic coated helix coil, may be provided securable to an apparatus requiring the antenna and having a tubular section therethrough that slidably supports the tubular section. In this regard, the conducting insert includes an end plug at a distal end thereof that has a first section with a reduced width substantially corresponding to a diameter of the tubular section and a second section with a width greater than the diameter of the tubular section. Alternatively, the end plug may have a stop cap secured thereto that is formed of a conducting material and has a width that is greater than the diameter of the tubular section. In this context, the end plug of the conducting insert is in electrical contact with the stop cap.

In accordance with another aspect of the invention, there is provided a method of constructing the flexible telescoping antenna noted above. The method includes the steps of (a) inserting the end section into the opening in the tubular section, (b) securing the end cap having a width greater than the opening to an end of the end section inside the tubular section, and (c) securing the conducting insert inside the tubular section in electrical contact with the end cap. The tubular section is inserted into the compact antenna in a friction fit such that the compact antenna supports the tubular section and the end section to an apparatus requiring the antenna. The method may further include securing the tubular section to a subsequent tubular section. Step (c) may be practiced by securing the conducting insert inside the tubular section radially offset from a central axis of the tubular section.

BRIEF DESCRIPTION OF THE DRAWINGS

These and further aspects and advantages of the present invention will be described in detail with reference to the accompanying drawings, in which.

DETAILED DESCRIPTION OF PREFERRED EMBODIMENTS

Figure 1:
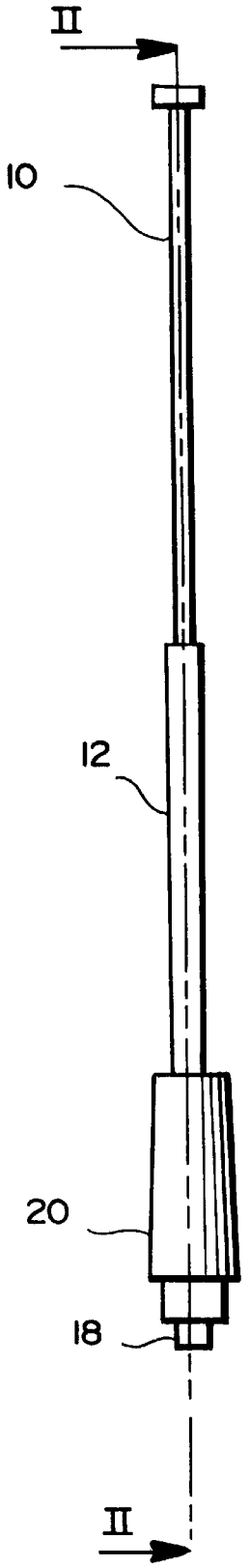
FIG. 1 is an elevation view of the flexible telescoping antenna according to the present invention.
Figure 2:
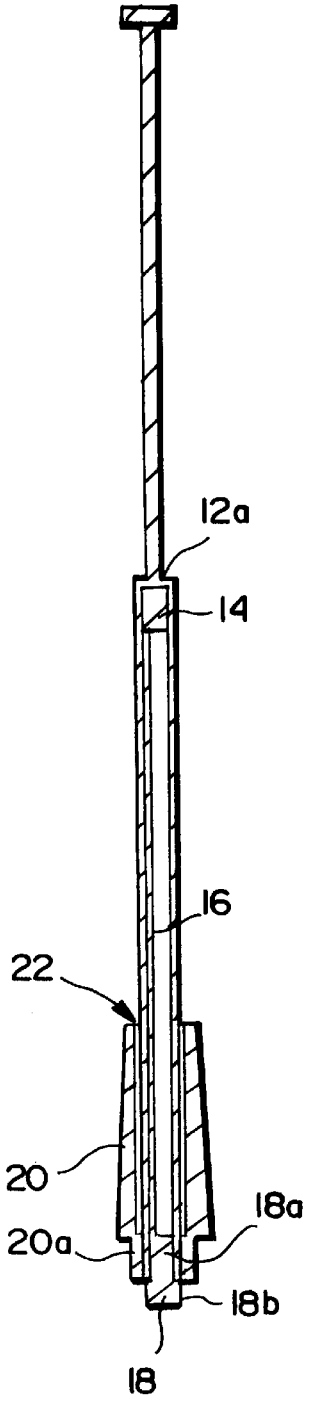
FIG. 2 is a cross-sectional view of the antenna illustrated in FIG. 1.

Referring to FIGS. 1 and 2, the assembly of the flexible telescoping antenna according to the present invention is illustrated. The antenna includes an end section 10 that is formed of a conductive material such as nickel titanium and is plastic coated. The end section 10 is slidably received in a tubular section 12, which is formed of a non-conducting material such as plastic. The end section 10 is inserted into the tubular section 12 through an opening 12*a* in the tubular section 12. An end cap 14 having a width that is greater than a diameter of the opening 12*a* is press fit or otherwise secured on the end section 10 to prevent the end section from being separated from the tubular section 12. The end cap 14 is formed of an electrically conducting material and is in electrical contact with the end section 10.

A conducting insert 16 is inserted in the tubular section 12 and extends substantially along the entire length of the tubular section 12. At its distal end, the conducting insert 16 includes an end plug 18 having a first section 18*a* with a reduced width substantially corresponding to the inside diameter of the tubular section 12 and a second section 18*b* having a width that is greater than the diameter of the tubular section 12. In an alternative configuration, the end plug 18 includes only the section 1 8a, and the enlarged section 18*b* is rather a stop cap secured to the end plug 18. In this regard, the stop cap 18*b* is formed of a conducting material and is in electrical contact with the end plug 18 of the conducting insert 16.

Referring to FIG. 2, the conducting insert 16 is formed of a thin conducting material such as nickel titanium such that the insert is disposed in the tubular section 12 radially offset from a central axis of the tubular section. Preferably, the conducting insert is disposed against an inside wall of the tubular section 12. By virtue of this arrangement, the end cap 14 maintains its electrical contact with the conducting insert 16 at any interval of extraction of the antenna. That is, the conducting insert is sandwiched between the end cap 14 and the inside wall of the tubular section 12. Thus, as the end section 10 is retracted, the end cap 14 maintains electrical contact with the conducting insert 16.

A compact antenna 20 that is attachable to a mobile communications device or the like includes a central channel 22 that receives the tubular section 12 in a friction fit. The compact antenna 20 thus supports the antenna structure. In one arrangement, the compact antenna includes a plastic coated helix coil which is in electrical contact with the end plug 18 of the conducting insert 16. When the compact antenna 20 includes the helix coil, the communications device is functional when the antenna is completely retracted. The compact antenna 20 is attachable to the mobile communications device in any suitable manner, such as screw threads or a press fit over section 20*a*.

As shown in FIG. 2, the electrical contact of the antenna conducting materials is preferably galvanic contact; however, by adding a thin dielectric spacing, the electrical contact can be achieved with a capacitive coupling. In addition, although the FIGURES illustrate a single tubular section 12 between the end section 10 and the compact antenna 20, those of ordinary skill in the art will appreciate that subsequent tubular sections could be provided. In this regard, each tubular section would include a similar conducting insert and a press fit cap or end plug similar to end cap 14.

The flexible telescoping antenna according to the invention utilizes plastic telescoping sections and conducting elements of solid small diameter flexible metal rods (or helices). The antenna is thus less susceptible to breakage allowing maximum mechanical deflection of the telescoping sections without permanent deformation of the antenna while providing optimum electrical performance.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A flexible telescoping antenna comprising:

an end section formed of a conducting material;

a tubular section formed of a non-conducting material, said tubular section slidably receiving said end section; and a conducting insert disposed in said tubular section in electrical contact with said end section, said conducting insert having an end plug at a distal end thereof engaging said non-conducting tubular section.

2. An antenna according to claim 1, wherein said end section is slidable through an opening in said tubular section, the antenna further comprising an end cap secured to an end of said end section, said end cap being formed of a conducting material and having a width that is greater than a diameter of said opening, wherein said conducting insert is in electrical contact with said end cap.

3. An antenna according to claim 2, wherein said conducting insert is disposed in said tubular section radially offset from a central axis of said tubular section.

4. An antenna according to claim 3, wherein said conducting insert is disposed against a wall of said tubular section.

5. An antenna according to claim 2, wherein said electrical contact is galvanic contact.

6. An antenna according to claim 2, wherein said electrical contact is achieved with a capacitive coupling.

7. An antenna according to claim 2, further comprising at least one subsequent tubular section formed of a non-conducting material, said at least one subsequent tubular section slidably receiving one of said tubular section and other subsequent tubular sections.

8. An antenna according to claim 2, further comprising a compact antenna securable to an apparatus requiring the antenna and having a channel therethrough, said tubular section being slidably supported in said channel.

9. An antenna according to claim 8, wherein said end plug includes a first section having a reduced width substantially corresponding to a diameter of said tubular section and a second section having a width greater than the diameter of said tubular section.

10. An antenna according to claim 8, wherein said end plug has a width substantially corresponding to a diameter of said tubular section, the antenna further comprising a stop cap secured to said end plug, said stop cap being formed of a conducting material and having a width that is greater than the diameter of said tubular section, wherein said end plug of said conducting insert is in electrical contact with said stop cap.

11. An antenna according to claim 8, wherein said compact antenna comprises a plastic coated helix coil.

12. An antenna according to claim 1, further comprising a compact antenna securable to an apparatus requiring the antenna and having a channel therethrough, said tubular section being slidably supported in said channel.

13. An antenna according to claim 12, wherein said end plug includes a first section having a reduced width substantially corresponding to a diameter of said tubular section and a second section having a width greater than the diameter of said tubular section.

14. An antenna according to claim 12, wherein said end plug has a width substantially corresponding to a diameter of said tubular section, the antenna further comprising a stop cap secured to said end plug, said stop cap being formed of a conducting material and having a width that is greater than the diameter of said tubular section, wherein said end plug of said conducting insert is in electrical contact with said stop cap.

15. An antenna according to claim 14, wherein said non-conducting material is plastic.

16. An antenna according to claim 1, wherein said end section is coated with a non-conducting material.

17. An antenna according to claim 1, wherein said non-conducting material is plastic.

18. An antenna according to claim 1, wherein said electrical contact is galvanic contact.

19. An antenna according to claim 1, wherein said electrical contact is achieved with a capacitive coupling.

20. A method of constructing a flexible telescoping antenna including an end section formed of a conducting material, a tubular section formed of a non-conducting material, and a conducting insert disposed in the tubular section in electrical contact with the end section, the conducting insert having an end plug at a distal end, the method comprising:

(a) inserting the end section into an opening in the tubular section;

(b) securing an end cap having a width greater than the opening to an end of the end section inside the tubular section; and (c) inserting the conducting insert inside the non-conducting tubular section in electrical contact with the end cap and securing the conducting insert with the end plug.

21. A method according to claim 20, further comprising inserting the tubular section into a compact antenna in a friction fit, the compact antenna supporting the tubular section and the end section to an apparatus requiring the antenna.

22. A method according to claim 20, further comprising securing the tubular section to a subsequent tubular section.

23. A method according to claim 20, wherein step (c) is practiced by securing the conducting insert inside the tubular section radially offset from a central axis of the tubular section.

24. A flexible telescoping antenna comprising:

an end section formed of a conducting material;

a tubular section formed of a non-conducting material, said tubular section slidably receiving said end section; and a conducting insert disposed in said tubular section in electrical contact with said end section regardless of a position of said end section along said conducting insert, said conducting insert having an end plug at a distal end thereof engaging said non-conducting tubular section.

25. A flexible telescoping antenna comprising:

an end section formed of a conducting material;

a tubular section formed of a non-conducting material, said tubular section slidably receiving said end section; and a conducting insert disposed in said tubular section in electrical contact with said end section, said conducting insert having an end plug at a distal end thereof engaging said tubular section, wherein said conducting insert is disposed in said tubular section radially offset from a central axis of said tubular section.

26. A method of constructing a flexible telescoping antenna including an end section formed of a conducting material, a tubular section formed of a non-conducting material and a conducting insert disposed in the tubular section in electrical contact with the end section, the conducting insert having an end plug at a distal end, the method comprising:

inserting the end section into an opening in the tubular section;

securing an end cap having a width greater than the opening to an end of the end section inside the tubular section; and inserting the conducting insert inside the tubular section in electrical contact with the end cap and securing the conducting insert with the end plug, wherein the inserting step includes securing the conducting insert inside the tubular section radially offset from a central axis of the tubular section.

* * * * *